United States Patent [19]

Francis

[11] 4,047,295

[45] Sept. 13, 1977

[54] SHAVING UNIT DISPENSER CONTAINER

[75] Inventor: John Frederick Francis, Woking, England

[73] Assignee: The Gillette Company, Boston, Mass.

[21] Appl. No.: 677,491

[22] Filed: Apr. 15, 1976

[30] Foreign Application Priority Data

Apr. 29, 1975 United Kingdom ..... 17796/75

[51] Int. Cl.[2] ..... B26B 21/24; B65D 83/10

[52] U.S. Cl. ..... 30/40.2; 206/356

[58] Field of Search ..... 30/40.2, 40; 206/228, 206/354, 356, 357, 359

[56] References Cited

U.S. PATENT DOCUMENTS

| | | | |
|---|---|---|---|
| 2,124,402 | 7/1938 | Huenergardt | 30/40 |
| 2,312,453 | 3/1943 | Testi | 30/40.2 |
| 3,002,607 | 10/1961 | Laverty | 206/228 |
| 3,834,018 | 9/1974 | Dawidowicz | 30/40.2 |

*Primary Examiner*—Jimmy C. Peters

*Attorney, Agent, or Firm*—Richard A. Wise; Oistein J. Bratlie; Scott R. Foster

[57] ABSTRACT

A dispenser for shaving units having blade and guard means permanently associated therewith, the dispenser including storage means for accommodating a plurality of the shaving units, locating means engageable by a razor handle with which the units are to be used, the storage means being movably coupled to the locating means to permit units in the storage means to be brought in turn into a position adjacent a head of the razor handle for transferring a unit from the storage means into engagement with the handle.

9 Claims, 5 Drawing Figures

SHAVING UNIT DISPENSER CONTAINER

This invention relates to dispensing containers for replaceable shaving units which comprise at least one blade and also a member, attached to the blade during manufacture and forming a permanent assembly therewith, which provides a guard surface for the cutting edge of the blade, the unit being adapted to ready engagement with and disengagement from a razor handle with which it is used for shaving, so that the unit as a whole can be replaced when the cutting edge of its blade becomes dulled.

A dispensing container in accordance with the invention comprises a storage member for accommodating a plurality of the shaving units in predetermined positions and protecting them during transport and storage, and a locating member engageable by a razor handle with which the units are to be used, to locate a head of the handle in a predetermined position, the storage member being movably coupled to the locating member to permit units stored in the storage member to be brought in turn into a position adjacent the head of a handle engaged with the locating member and readily transferred from the storage member into operative engagement with the handle.

By the head of the handle, it is meant the part of the handle with which the shaving units are adapted to engage.

In a preferred form of dispensing container for shaving units which are adapted to be engaged with the handle by sliding movement in a direction longitudinal of the units, the storage member is rotatable relative to the locating member and the units are disposed with their lengths parallel to the axis of rotation and spaced around that axis at equal distances from it, so that, by an appropriate degree of rotation, each unit in turn can be brought into a position adjacent to and aligned with the head of a handle which has been positioned by the locating member, longitudinal movement of the correctly positioned unit being then all that is required to effect its correct engagement with the handle.

The particular embodiment of the invention which is shown in the drawings and described below has been designed for use with shaving units and co-operating razor handles of the character described in U.S. Pat. Nos. 3,703,764; 3,724,070; and 3,768,162, but with any necessary modifications it may be used with shaving units and/or handles of other designs.

Figure 1:
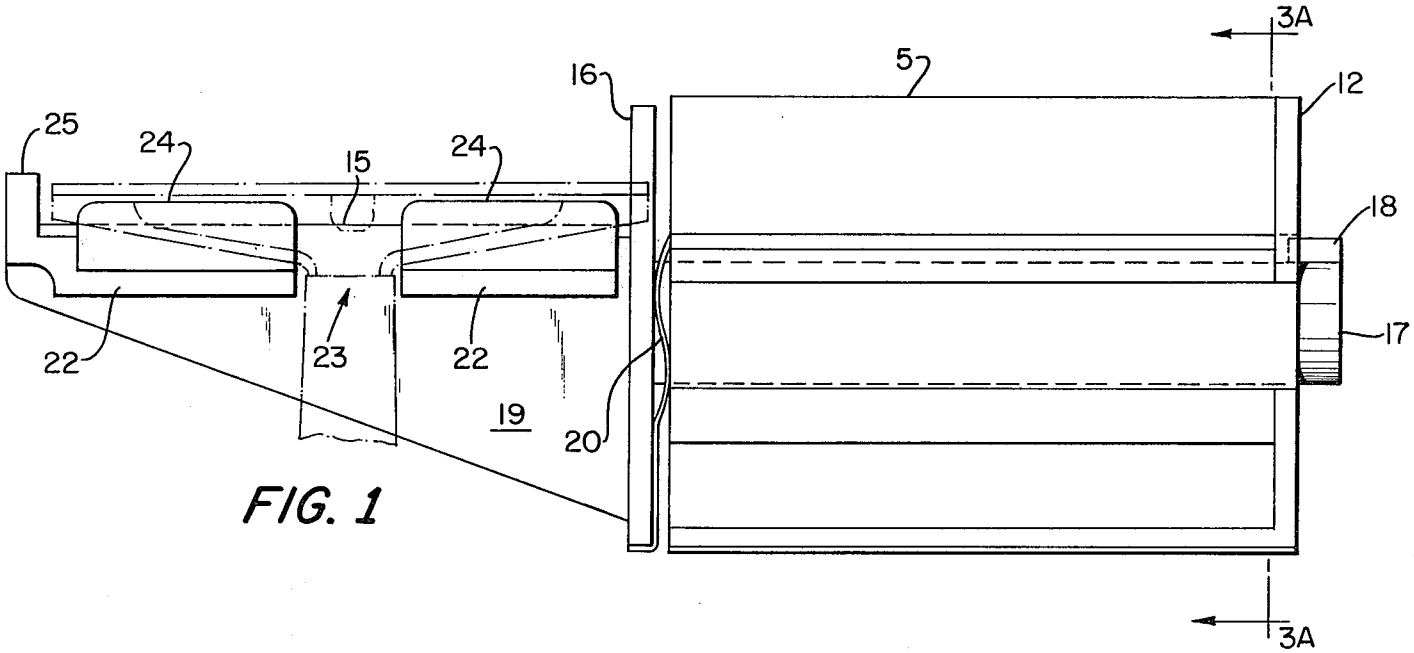
FIG. 1 is a side view of the complete dispensing container.
Figure 4:
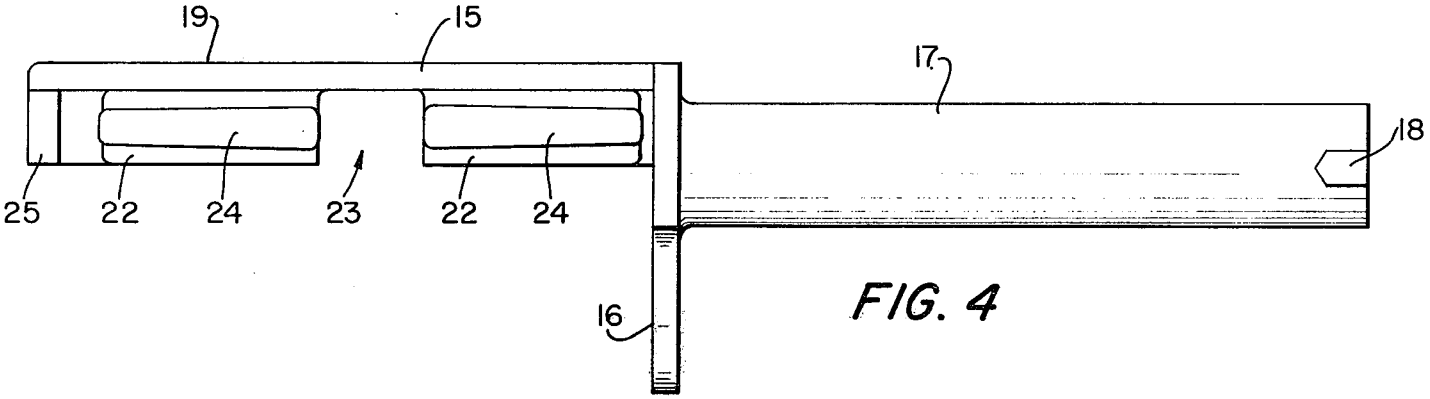
FIG. 4 is a plan view of the locating member alone.
Figure 3:
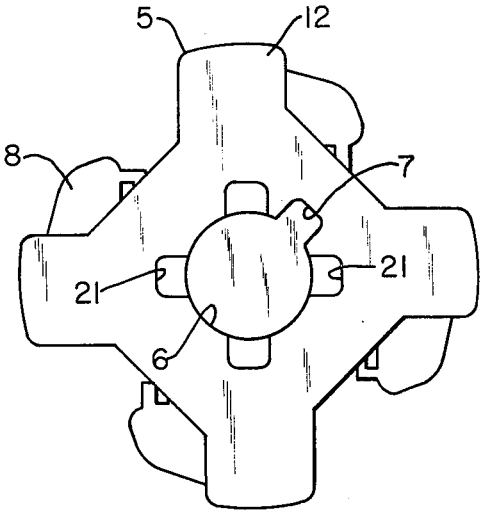
FIG. 3 is an end view (from the right of FIG. 1) of the storage member alone.
Figure 3A:
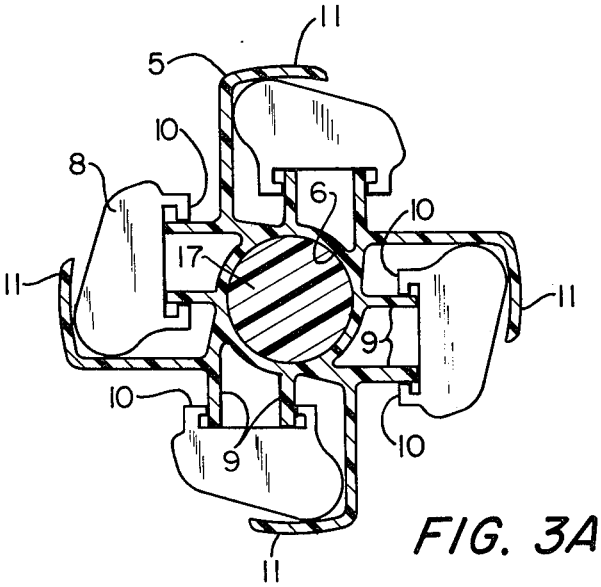
FIG. 3A is a sectional view taken along line 3A-3A of FIG. 1.

In the construction illustrated, a storage member 5 comprises a one-piece molding of suitable plastic, formed with a central axial bore 6 (FIG. 3) having a key-way 7, and shaped to provide four storage positions for shaving units 8, disposed symmetrically about the axis. Each storage position provides a pair of parallel outwardly projecting ribs 9 (FIG. 3A), adapted to engage between undercut ribs 10 of the shaving unit 8 which serve for coupling the latter to a razor, and also a hood-like portion 11 of approximately L-section which extends sufficiently over the shaving unit to protect the cutting edges of its blades and to prevent the unit from being disengaged from the ribs 9 by transverse movement. The ribs 9 and the hood 11 extend the full length of the storage member 5 and form storage compartments open at one end (the left in FIG. 1), into each of which a shaving unit 8 can be inserted by longitudinal sliding movement. A web or end plate 12 (FIG. 1) prevents the units 8 from leaving the right hand ends of these compartments.

A locating member 15 is also formed as a unitary molding of a suitable plastics material. It comprises an incomplete disc 16, from which there projects to one side a shaft 17 carrying a tooth 18 at its extremity and to the other side a plate-like member 19. The bore 6 of storage member 5 is passed over the shaft 17 (FIG. 3A) of the locating member, the key-way 7 allowing passage to the tooth 18, and the storage member 5 is turned to bring the tooth 18 over the outer face of the end plate 12, against which it is urged by a spring washer 20 interposed between the disc 16 and the adjacent end of the storage member 5. The end plate 12 is formed with four recesses 21 in which the tooth 18 will engage as the storage member is rotated, thus indexing the latter into one of its four operative positions.

The plate-like member 19, which in use is conveniently held in a substantially vertical position between the thumb and forefinger of the user's left hand, has at its upper edge a pair of projecting ledges 22, separated by a gap 23, each ledge carrying an upstanding projection 24.

Figure 2:
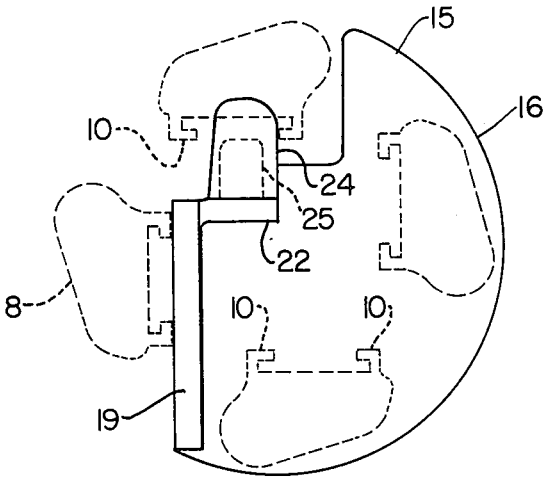
FIG. 2 is an end view (from the left of FIG. 1) of the locating member alone, but with the positions of the shaving units indicated in dotted lines.

A razor handle of the type shown and described in U.S. Pat. No. 3,768,162 and shown in phantom in FIG. 1 to which a shaving unit is to be applied is engaged with the locating member by passing slots in its head over the projections 24 and allowing the head to rest on the ledges 22, the neck of the handle being accommodated in the gap 23. With the handle so located and supported, the shaving unit in the uppermost position in the storage unit is precisely aligned with the co-operating part of the handle and can be engaged therewith by simply sliding it (to the left) out of the storage member and into engagement with the handle, until further movement is arrested by a stop 25 on the member 19, when the unit will be correctly positioned on the handle, which can be lifted away, ready for use. By turning the storage member through 90°, the next shaving unit is brought into position for loading and the empty storage compartment is moved to a position (on the left of FIG. 2) in which its open end is unobstructed by the disc 16, so that a discarded unit can be inserted into it.

As described above, the storage and locating members are separable, so that when all the units in the storage member have been used, the storage member can be discarded and a fresh storage member fitted to the same locating member. However, the two members may be permanently connected together during manufacture, the complete device being discarded after use. Numerous other modifications of the particular construction described are also possible within the scope of the appended claims.

Having thus described my invention what I claim as new and desire to secure by Letters Patent of the United States is:

1. A dispensing container for shaving units having blade means permanently fixed to a body member having a guard portion and connector means by which the unit is slidably attachable to a head portion of a razor handle, said dispensing container comprising storage means for mounting a plurality of said shaving units such that said blade means are covered by portions of said storage means and portions of said body member are exposed, and locating means engageable by said head portion of said razor handle to locate said head portion of said handle in a predetermined position, said storage means being rotatably coupled to said locating means whereby said storage means may be rotated relative to said locating means so that said units mounted in said storage means may be brought in turn into a position adjacent said head portion of said handle engaged with said locating means, said storage means for mounting said shaving units including ribs on which said shaving units are slidably disposed, whereby the exposed body portion of a shaving unit may be manipulated by an operator to slide said shaving unit longitudinally of said shaving unit from said storage means into operative engagement with said handle.

2. A container according to claim 1, wherein the storage means is rotatable relative to the locating means about an axis parallel with the length of the units stored in the storage means.

3. A container according to claim 2, wherein the locating means includes a shaft rotatably received in an axial bore of the storage means.

4. A container according to claim 3, wherein the shaft has a radial projection at a free end thereof, opposite a handle engaging part of the locating means, and said projection abuts an axial end wall of said storage means to retain the storage means on said shaft.

5. A container according to claim 4, wherein detent means are provided on said storage and locating means for resiliently holding the storage means in those positions relative to the locating means in which a stored unit is aligned with said head portion of said razor handle engaged with the locating means.

6. A container according to claim 4, wherein said projection is urged into contact with said end wall by a spring acting between another end of said storage means and the locating means, and said end wall has a plurality of angularly spaced recesses therein for receiving said projection to retain resiliently said storage member in those angular positions thereof in which stored units are aligned with said head portion of said razor handle engaged with said locating member.

7. A container according to claim 1, wherein said locating means has a stop for limiting longitudinal sliding movement of said units during transfer thereof to ensure correct engagement of said units with said razor handle.

8. A container according to claim 1, wherein said storage means comprises a plurality of hoods, one for each unit accommodated in said storage means, for covering and protecting cutting edges of said units.

9. A container according to claim 1, wherein the locating means and storage means are detachably coupled together.

* * * * *